US005769274A

United States Patent [19]

Behar

[11] Patent Number: 5,769,274

[45] Date of Patent: Jun. 23, 1998

[54] PUMP DISPENSER FOR A CONTAINER WITH A FLEXIBLE BAG

[75] Inventor: Alain Behar, Eu, France

[73] Assignee: Sofab, Le Treport, France

[21] Appl. No.: 564,189

[22] PCT Filed: Apr. 6, 1995

[86] PCT No.: PCT/FR95/00440

§ 371 Date: Dec. 7, 1995

§ 102(e) Date: Dec. 7, 1995

[87] PCT Pub. No.: WO95/27569

PCT Pub. Date: Oct. 19, 1995

[30] Foreign Application Priority Data

Apr. 8, 1994 [FR] France ..... 94 04181

[51] Int. Cl.[6] ..... B05B 11/00

[52] U.S. Cl. ..... 222/95; 222/105; 222/321.9

[58] Field of Search ..... 222/95, 105, 321.1, 222/321.7, 321.9

[56] References Cited

U.S. PATENT DOCUMENTS 5,156,299 10/1992 De Caluwe et al. ..... 222/105 X 5,474,212 12/1995 Ichikawa et al. ..... 222/105

FOREIGN PATENT DOCUMENTS 2685285 6/1993 France .

2695111 3/1994 France .

2155117 9/1985 United Kingdom .

*Primary Examiner*—Kevin P. Shaver

*Attorney, Agent, or Firm*—Bacon & Thomas

[57] ABSTRACT

A dispenser for substances that are at least partially fluid includes an outer casing (1) fitted with a pump (4) having a tubular body (5). The tubular body is provided with a vent (5*e*) that is closed when a piston of the pump is in a rest position. A flexible bag (3) is connected to the pump beneath the vent by means of a bushing (2) that forms a ring which has a cylindrical skirt (2*b*) connected to a top band (2*a*) and forms a flange (2*c*, 2*e*) for centering and support purposes against the outer casing. A counter-flange (7*a*) connects the pump to the outer casing in a sealed manner. Communication (2*f*) is established between a lower intermediate space (1*c*) surrounding the bag and an upper intermediate space (1*b*) that is associated with the vent. Conservation of the substance is improved and filling and purging air are simplified.

9 Claims, 4 Drawing Sheets

PUMP DISPENSER FOR A CONTAINER WITH A FLEXIBLE BAG

BACKGROUND OF THE INVENTION

1. Field of the Invention

The present invention relates to packaging substances, including both liquids and substances that are at least semi-liquid or creamy, in a dispenser that possesses a rigid case fitted with a dispenser member enabling its contents to be expelled in successive measured quantities.

2. Related Technology

Commonly, an outer casing serves as a receptacle and is closed by a dispenser member. The dispenser member comprises a mechanism enclosed in a tubular body having a bottom inlet. The mechanism is controlled by pressing down a hollow rod which projects upwards and that serves as an outlet duct or nozzle. The rod is upwardly biased by a return spring. The dispenser member may be a valve, in which case the substance is expelled by pressure from a propellant gas inserted on initial packaging. Alternatively, the dispenser member may be a pump having an axial piston driven by the nozzle for extracting the desired quantity of substance via suction established by the piston rising in its chamber and then for expelling said quantity to the outside via the force of the descending piston. To bring the pressure inside the receptacle back into equilibrium, the pump possesses a vent which is closed by the piston while in its rest position but is open and allows a limited quantity of air to enter during each use.

However, with such devices, the substance is often not contained directly in the rigid outer casing, but in a flexible bag housed therein. The flexible bag possesses an opening which is connected to the dispenser member, the outer casing merely constituting an outer cover. This disposition serves in particular to protect the quality of the substance during long-duration storage. In particular, when the dispenser member is a pump, it enables the substance to be conserved while it is protected from the air. It also makes it possible to prevent volatile substances from evaporating.

In the most convenient of known structures, the dispenser member and the flexible bag are connected together by a ring-forming bushing which possesses a cylindrical skirt attached to an upper band. The opening of the bag is fixed in a sealed manner to the skirt. At least a portion of the tubular body of the dispenser member penetrates through the band and is in turn secured thereto in a sealed manner.

The bushing advantageously possesses a flange attached to the band for centering and support purposes. After the bag has been inserted in the outer cover, the flange allows the bag to be held in the opening of the cover to allow the substance to be injected therein. Thereafter the dispenser member, a pump in the present case, is installed. The dispenser member can be fixed to the bushing and the assembly can be fixed to the opening of the cover using all sorts of members with various connection means such as screws, two regions of leak-proof mutual engagement, etc.

Finally, even when a pump is used, the dispenser member has no vent. However, to allow the bag to collapse progressively as substance is extracted therefrom by the pump without giving rise to suction in the space left empty between the bag and the cover, this space is connected to the atmosphere via a balancing channel, orifice, or path through the cover or beneath the bushing.

OBJECTS AND SUMMARY OF THE INVENTION

The invention relates to an improvement of such flexible bag dispensers that are fitted with a metering pump. It is based on the observation that conservation of the substance can be further improved therein since the presence of permanent communication between the intermediate space and the atmosphere causes the substance to age, given that the bag is not absolutely impervious.

The invention therefore provides a dispenser for a substance that is at least partially fluid, the dispenser possessing an outer casing provided with:

a pump having a tubular body controlled by acting on a piston having an axial nozzle;

a flexible bag sheltered inside the casing, connected to the pump by a bushing which forms a ring having a cylindrical skirt connected to a band, an outlet of the bag being fixed in a sealed manner to the skirt, a portion of the tubular body penetrating into the band and fitting thereagainst in a sealed manner, the bushing also having a larger flange for centering and support purposes against the casing; and members for fastening the pump to the casing;

wherein the pump is provided with a vent that is closed by the piston at rest; the bushing is connected thereto beneath the vent, above which there is a counter-flange holding the pump to the casing in a sealed manner; and communication is provided between a lower intermediate space surrounding the bag and an upper intermediate space in communication with the vent.

According to an advantageous characteristic, the band for fitting the bushing in a sealed manner to the bottom portion of the tubular body is in the form of a collar of smaller diameter and the bottom portion of the tubular body fits in a sealed manner merely as a friction fit against a cylindrical inside bearing surface of the band.

The counter-flange is an integral part of a closing collar of the tubular body. The support flange has a cylindrical inside face carrying ribs centering the pump in an initial installation position.

Also, the intake of the pump is directly at the bottom end thereof. The bushing forms therebeneath an inlet grid having, in addition to a lateral intake orifice, a central orifice that supports a tube or a drain.

In addition, according to another characteristic, the coupling ring of the bushing includes a safety valve that prevents flow passing from the inside toward the outside. The safety valve comprises two elementary parts that are nested together in a sealed manner.

Furthermore, the rim of the inner part comprises a chamfered seat for the valve. The valve member comprises a pellet which is connected at the periphery of its conical bearing surface to the outer part via an elastically deformable perforated ring and which is provided with a pusher that leaves channels for passing the substance when making contact with the pump.

Preferably, a peripheral zone surrounding the pump and the bag, which is in communication with the vent, is filled with an inert gas.

The invention also provides a method of packaging a dispenser of the above-mentioned type, characterized in that after the bushing has been put into place and the bag has been filled, the pump is placed at the inlet of the bushing. The assembly is placed in a vacuum so as to purge the bag. The pump is pushed as a friction fit into the band for fitting it in a sealed manner to the bushing. A gas is caused to penetrate into the peripheral zone surrounding the pump and the bag. Finally the pump is sealed to the cover.

According to the invention, the pump is a model that has a vent and the bushing is connected in a leak-proof manner beneath the vent. In contrast, above the vent a counterflange connects the tubular body of the pump in a sealed manner to the outer cover, thereby creating a second intermediate space in association with the vent above the bushing and around the tubular body. An open passage puts the two intermediate spaces into communication between an inside front face and an outside rear face of the bushing, thereby recreating a single peripheral zone. This zone is thus connected to the atmosphere via the vent of the pump only temporarily each time the pump is used. This suffices to balance the bottom intermediate space around the bag by passing air via the top space, while reducing to nothing the gas exchanges that could otherwise arise through the bag between the substance inside the bag and the atmosphere. In addition, for commercialization purposes, it becomes possible to fill the peripheral zone with an inert gas such as nitrogen, thereby protecting the substance better still over a long period until it is put into operation by the client user.

BRIEF DESCRIPTION OF THE DRAWINGS

The invention will be better understood and various characteristics will be explained on reading the following description of advantageous embodiments accompanied by the drawings wherein.

DETAILED DESCRIPTION

The dispenser shown in the figures comprises an outer casing 1 whose opening, assumed to be circular in this case, receives a bushing 2 that is essentially made up of two concentric rings. The first constitutes a sealed connection ring, comprising a ferrule whose top portion forms a band 2*a* and which is extended downwards by a skirt 2*b*. The skirt supports a flexible bag 3 that is to contain a substance P. The opening of the bag is placed around the skirt and is fixed in a sealed manner to an outside face thereof. The second ring comprises a cylindrical ferrule 2*c* that is of larger diameter than skirt 2*b*. The cylindrical ferrule 2*c* is attached at a bottom end to a top edge of band 2*a* via a projection 2*d*. Ferrule 2*c* is provided at its own top end with a flange 2*e*. By centering in and resting on an outlet of outer casing 1, flange 2*e* serves as a supporting and fastening member. Level with projection 2*d*, bushing 2 has three slots 2*f* passing therethrough which are conventionally obtained by cores penetrating into molds for manufacture by injection molding.

Figure 1A:
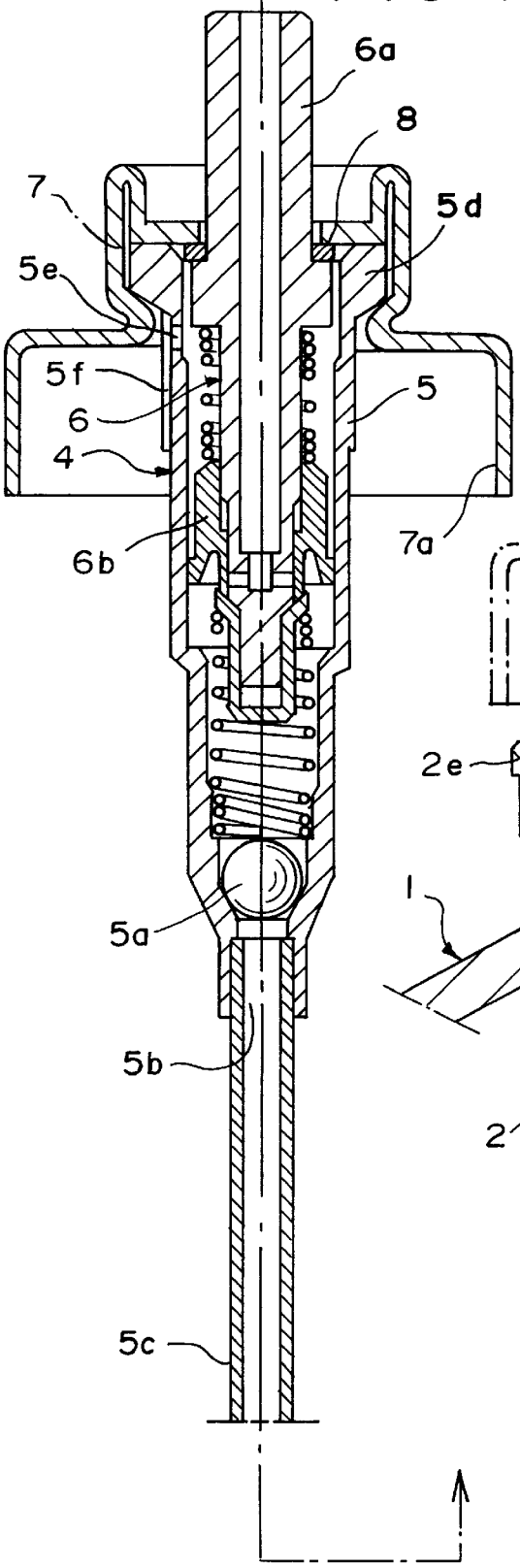
FIGS. 1*a* and 1*b* show in fragmentary longitudinal section a dispenser and an outer casing of the invention, respectively, before being assembled.
Figure 1B:
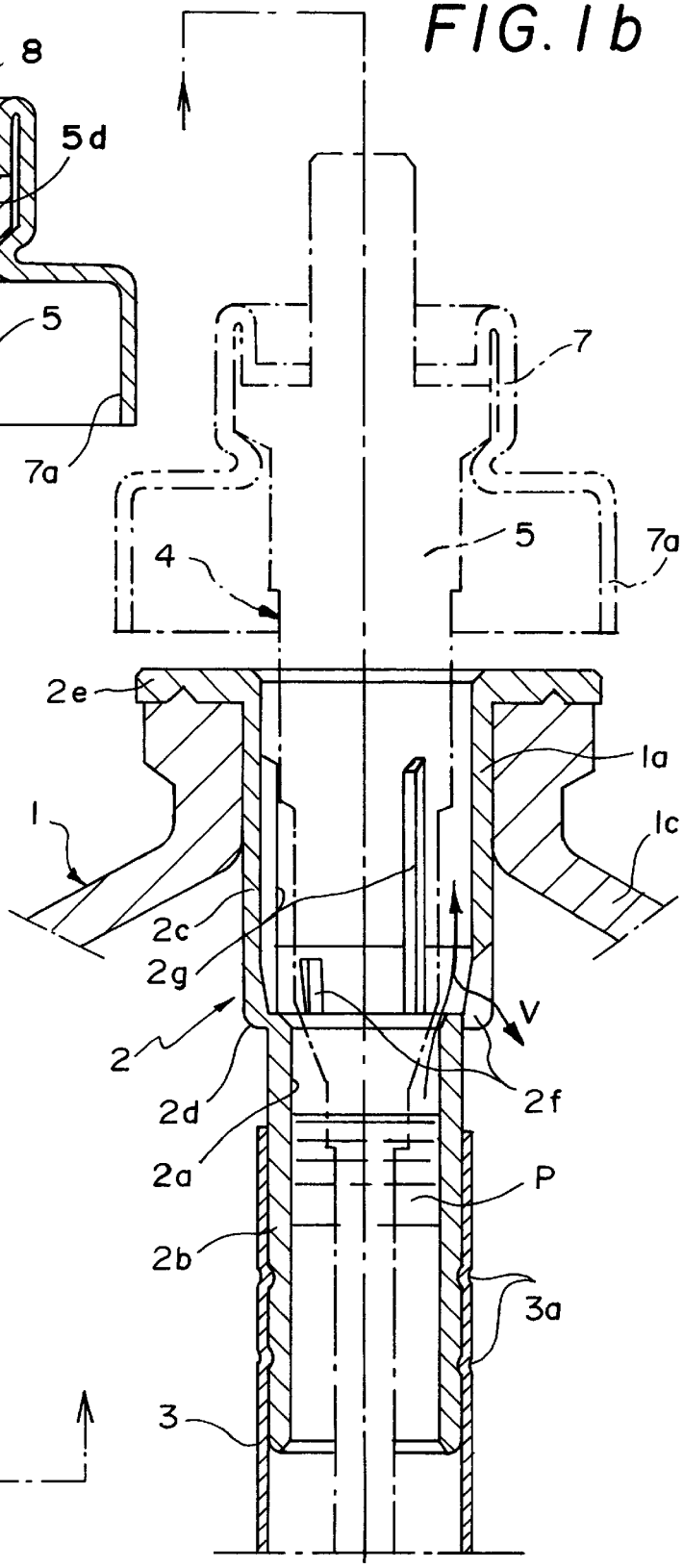
Figure 1C:
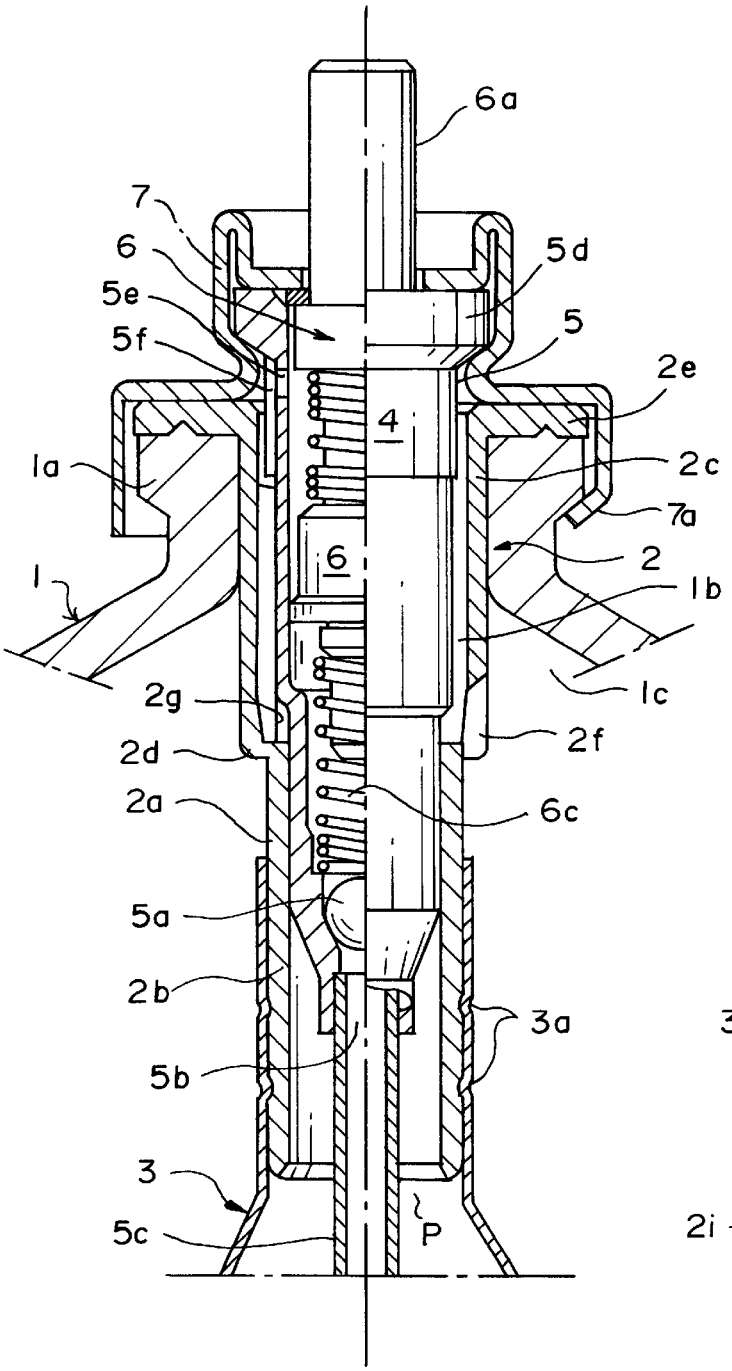
FIG. 1*c* shows the dispenser and outer casing shown in FIGS. 1*a* and 1*b*after being assembled.

Bushing 2 receives a conventional type of dispenser pump 4 which is shown in full section in FIG. 1*a*, in outline in FIG. 1*b* and in partial section in FIG. 1*c*. A tubular body 5 of the pump comprises two successive cylinders of decreasing diameter, and includes a ball inlet valve 5*a* associated with a bottom orifice 5*b* connected to a dip tube 5*c* having a flow conduit through which fluid substance to be pumped flows. A collar 7 crimped to a rim 5*d* of the body retains a piston 6 therein. Piston 6 has a hollow rod passing through the collar to form an axial nozzle 6*a*.

Piston 6 includes a sliding sleeve 6*b* which serves both as a sealing gasket and as an outlet non-return valve. It co-operates with a return spring. At rest, piston 6 is urged upward by a spring 6*c* and provides sealing against collar 7 via a sealing ring 8. However, a vent hole 5*e* passes through a wall of body 5 near the top thereof, above sleeve 6*b*.

In the assembled position, shown in section in FIG. 1*c*, the bottom cylinder of the tubular body fits in a sealed manner on a cylindrical inside bearing surface of band 2*a*, preferably merely by being a tight fit, thereby isolating substance P contained in bag 3 from the outside. The bag is thus advantageously fixed in a sealed manner to skirt 2*b* by adhesive or via two weld lines 3*a* located outside the band-engaging zone of the bottom cylinder of the tubular body so as to avoid deforming the plastics parts in this zone.

Collar 7 expands into a counter-flange 7*a* for crimping against a rim 1*a* of the outer casing, thereby compressing flange 2*e* of the bushing, which thus serves as a sealing gasket. The profiles of the tubular body and of the bushing match. A well is formed by ferrule 2*c* leaving an upper intermediate space 1*b* between the two parts, if necessary by means of a groove 5*f* formed in a thickening of the outside face of the top cylinder of the tubular body and extending to vent 5*e*. The intermediate space is above bushing 2, but below collar 7.

In this way, the outer casing serves only as a protective cover. Lower intermediate space 1*c* left between outer casing 1 and bag 3 is normally closed, but is put temporarily into communication with the atmosphere via slots 2*f*, space 1*b*, and vent 5*e* every time pressure on nozzle 6*a* moves piston 6 away from sealing ring 8. This makes it possible to balance the pressure therein on each occasion the pump is actuated, but without genuinely renewing the air.

As already mentioned above, for packaging purposes, bushing 2 and bag 3 in a collapsed condition are placed in outer casing 1. A filling spout is inserted therein and engages band 2*a*. A substance is then injected, thereby inflating the bag. The spout is then withdrawn. Pump 4 is then installed as shown in chain-dotted lines in FIG. 1*b*. The assembly can then be purged in a vacuum chamber while the peripheral zone or the bag is still in direct communication with said chamber via slots 2*f*, or alternatively the inside of skirt 2*b* via space 1*b*, as shown by double-headed arrow V. To facilitate this operation, ribs 2*g* for centering the pump in a half-way position are preferably provided on an inside face of ferrule 2*c* in alternation with slots 2*f*. The pump is then pushed into band 2*a*, thereby establishing a friction seal and closing the bag. The peripheral zone is filled with air or with a nitrogen atmosphere in such a manner that the pressure in space 1*c* is sufficient to cause the bag to shrink slightly by expelling substance from inside the pump but without raising sleeve 6*b*. Finally, the dispenser is sealed with the pump pressed down as shown in FIG. 1*c*, thus establishing leak-proof fixing of collar 7 on rim 1*a*.

The substance is then completely protected from air, since the peripheral zone is normally further closed by sealing ring 8.

Figure 2:
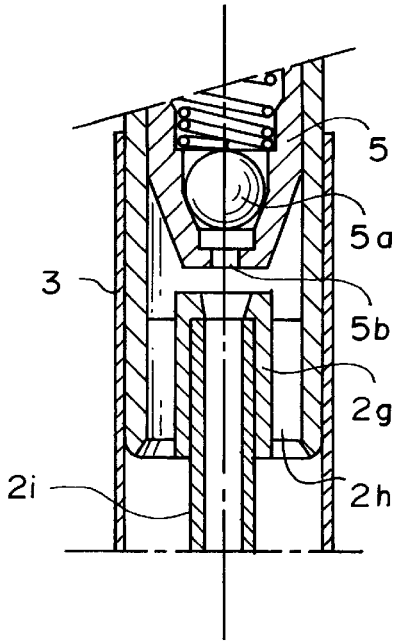
FIG. 2 shows a detail of a multiple-inlet variant of the embodiment shown in FIGS. 1*a* and 1*b* for semi-liquids or creams.

FIG. 2 shows a modification in which the bottom intake of the pump is adapted for receiving semi-liquid substances. The intake is formed directly by orifice 5*b* at the end of the body, with substance being taken from the top of bag 3. However, beneath the intake, ferrule 2 forms an inlet grid 2*h* at end of the skirt 2*b* which carries the bag. Inlet grid 2*h* possesses, in addition to lateral intake orifices, a central orifice which supports a tube 2*i* that extends to the bottom of the bag. By forming a drain, this tube suffices to prevent flattening of the bag as use progresses. Such flattening would finally cause a portion of the contents to be trapped in the bag.

Figure 3:
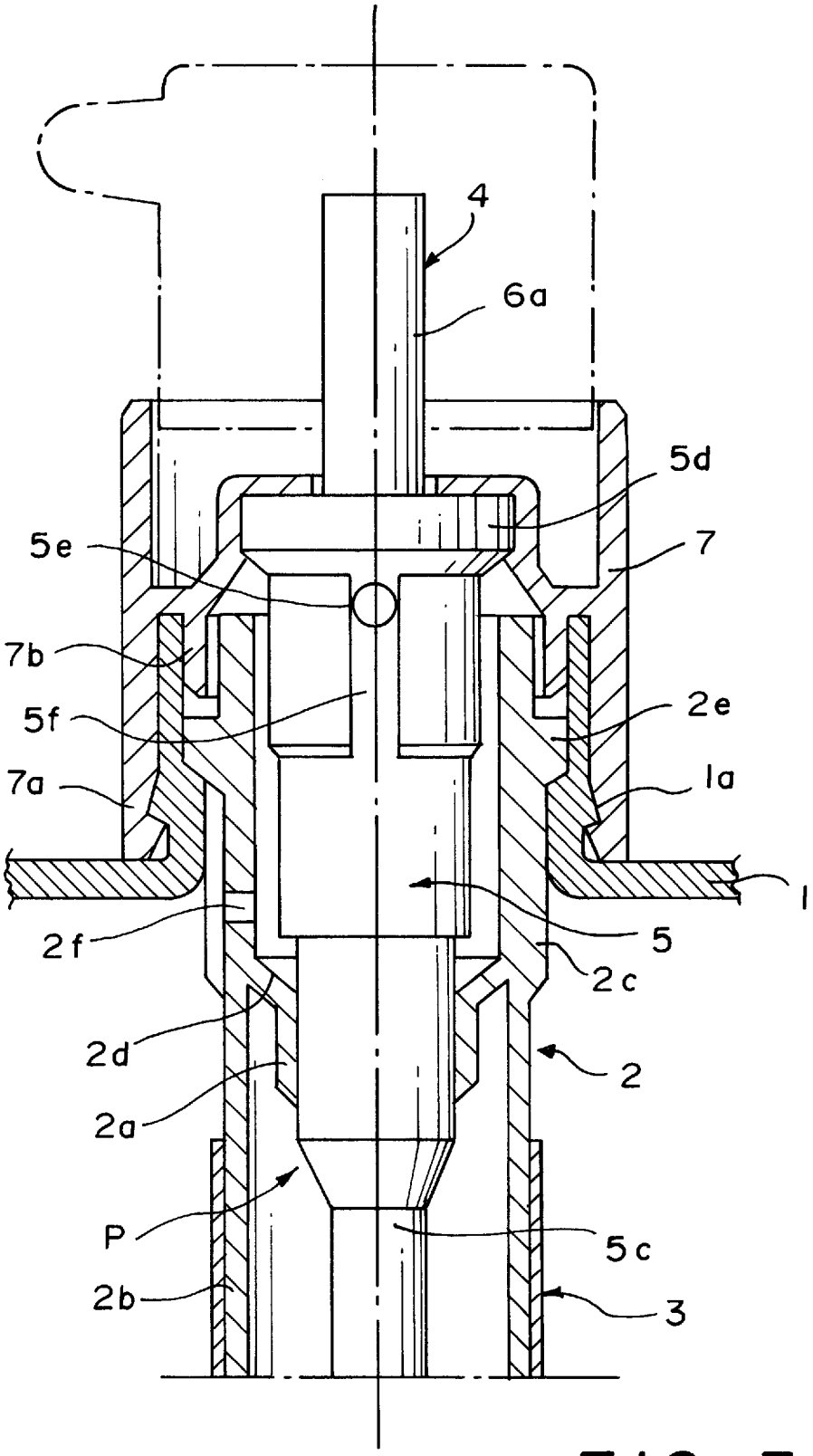
FIG. 3 shows a similar embodiment.

In the embodiment shown in FIG. 3, a head serving as a pushbutton and fitted with an appropriate outlet nozzle is shown in chain-dotted lines. The general structure of the device is similar to that of FIG. 1*c* and its various parts are given the same references. The main differences result from the fact that the dispenser member is fitted to an outer casing made of synthetic material.

The outlet of bag 3 is of larger diameter. The step between skirt 2*b* and ferrule 2*c* is smaller, being reduced in practice to the thickness initially occupied by the folded wall of the bag. In contrast, to enable band 2*a* to be a friction fit on the diameter of the bottom portion of tubular body 5, band 2*a* is in the form of a smaller internal collar. Flange 2*e* does not bear against the rim of outer casing 1, but on a shoulder inside its neck. Collar 7 is of synthetic material and is merely snap-fastened on rim 5*d* of the tubular body. Collar 7 directly provides sealing against outer casing 1 by means of a lip 7*b* and also provides counter-flange 7*a* which is subsequently snapped behind rim 1*a* of outer casing 1 (which may be annular or otherwise) forming a catch therefor. Flange 2*e* therefore plays no role in sealing outer casing 1. This structure makes it possible to manufacture all of the parts by injection molding and to assemble them by mutual engagement.

It will be observed that numerous variants are possible. In particular, the counter-flange could be different in appearance, being formed by an independent cap that clamps against both the collar and the outer casing. Communication between the two spaces 1*b* and 1*c* of the peripheral zone is formed via a lateral hole 2*f*. Communication could naturally also be provided, for example, by a groove passing through flange 2*e*.

Figure 4:
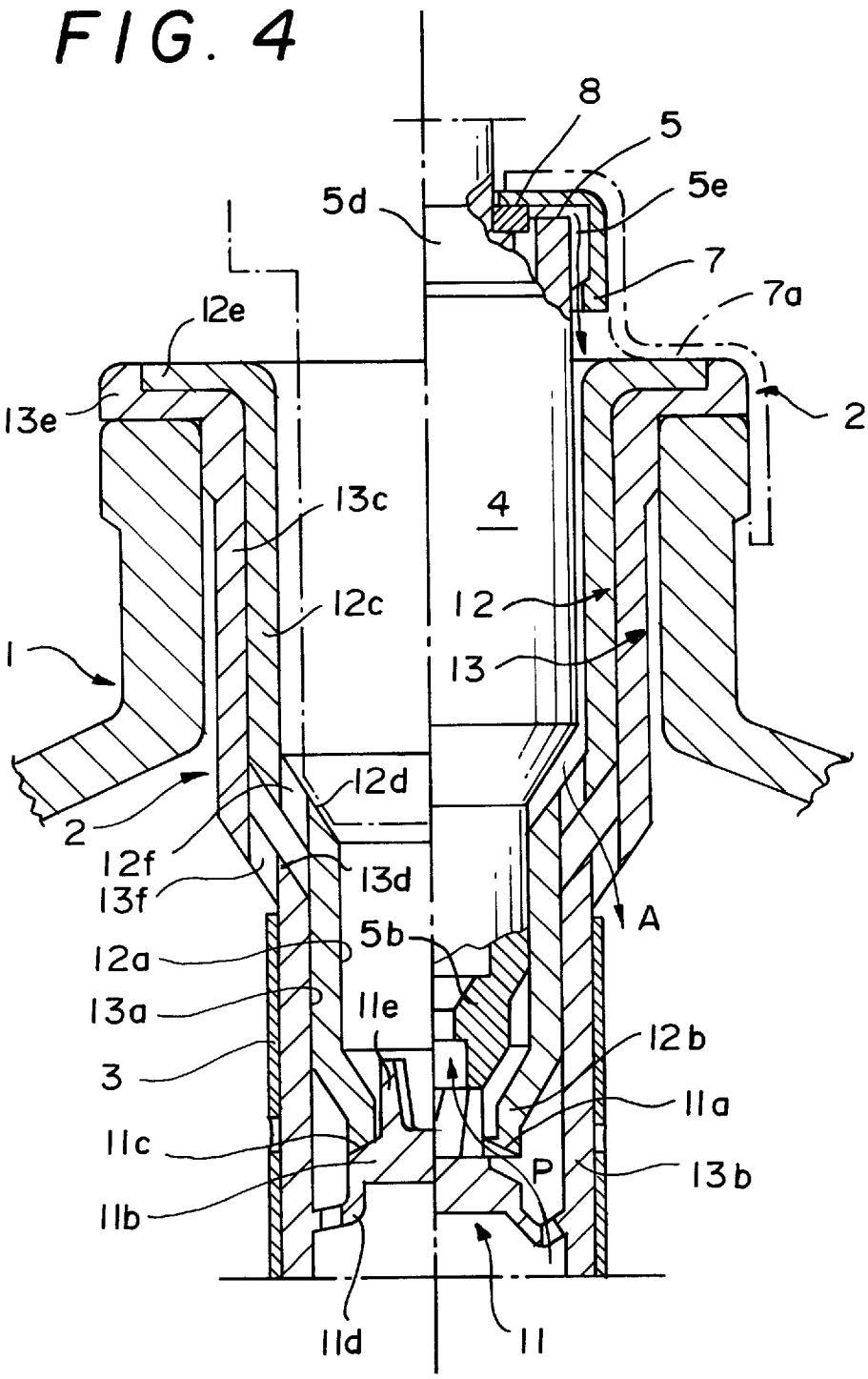
FIG. 4 shows another embodiment of the invention useful for thick substances and including a safety valve.

FIG. 4 shows another embodiment in which the coupling ring of bushing 2 includes a safety valve 11 beneath pump 4 that does not allow communication from the inside to the outside. Safety valve 11 comprises inner and outer parts 12 and 13 nested one in the other. The other parts retain the same references.

In this case, inner part 12 forms a sealing band 12*a* suitable for fitting to the bottom portion of the tubular body beneath which a bottom rim 12*b* forms a seat having a chamfered bottom bearing surface 11*a* for valve 11. It is itself engaged in a sealed manner in outer part 13 around a wall 13*a* extending to a skirt 13*b* whose outside face carries flexible bag 3 and whose inside face carries a valve member 11*b* suitable for co-operating with a seat 11*a*.

This bottom ring of outer closure plug part 13 connects via a shoulder 13*d* to a ferrule 13*c* of a flange 13*e* for providing centering and support, flange 13*e* resting on the edge of outer casing 1. In the version shown, band 12*a* of inner part 12 is itself connected via a shoulder 12*d* to a ferrule 12*c* of a similar flange. Ferrule 12*c* engages in ferrule 13*c* and in turn rests thereagainst via a flange 12*e*. The bushing is thus made up of two parts, with two walls that touch one another for the most part separating in the vicinity of shoulders 12*d* and 13*d* while being connected together in a sealed manner level with band 12*a*. The inside shape and the dimensions cf the bushing are adapted to centering and supporting pump 4. Within the shoulders, slots 12*f* and 13*f* establish communication between vent 5*e* of the pump and space 1*c* surrounding bag 3.

Valve member 11*b* comprises a pellet or plug extending substantially perpendicularly relative to the vertical axis of pump 4. The pellet is connected at the periphery of a conical bearing and sealing surface 11*c* to skirt 13*b* via an elastically deformable perforated ring 11*d*. To have even greater flexibility, this ring is of substantially V-shaped cross-section.

In addition, valve member 11*b* is provided with a pusher 11*e* which, on making contact with the pump, leaves space for allowing the substance to pass. Valve member 11*b* comprises three fingers whose tips are intended to come into contact with the end edge of bottom intake orifice 5*b* without closing said orifice when pump 4 is in place.

The lefthand portion of FIG. 4 shows valve 11 in its closed position in the absence of a pump, while the righthand portion of the figure shows valve 11 in its open position with the valve member being separated from its seat by said pump being installed in a sealed manner. It may incidentally be observed that in the present case collar 7 is used solely for closing the pump, while counter-flange 7*a* is formed by a separate part tightly engaged thereon prior to the pump being crimped to outer casing 1. The vent shown comprises a groove formed in the bearing surface of pump flange 5*d* and extending to sealing ring 8.

Bag 3 is initially mounted on ferrule 2 which is itself engaged on the neck of outer casing 1. In this position bag 3 is filled by means of a substance injection tube P (chain-dotted lines) that bears in a sealed manner against shoulder 12*d*, the valve being opened by ring 11*d* deforming under the effect of the pressure and the substance penetrating through the peripheral perforations. After filling, the valve closes, thereby protecting the contents of the bag from air.

Installation of the pump can thus be deferred without harm. When the pump is installed, its bottom end presses against fingers 11*e*, thereby reopening valve 11 by pushing down valve member 11*b*. A passage is thus opened for the substance along the path marked by the arrow P. Air entering via vent 5*e* of the pump can balance pressure during operation by passing through slots 12*f* and 13*f* along arrow A.

The use of a pump with a dip tube enabling substance to be taken from the bottom of the bag merely requires force to be applied when installing the pump so as to enable the bevelled end of the tube to remove the valve member by tearing through its ring.

I claim:

1. A dispenser for a fluid-like substance comprising:

an outer casing having an outlet opening;

a pump including a piston, a tubular body and an axial nozzle, activation of the piston being carried out by displacing the nozzle;

said pump further including a vent normally closed when the piston is in its rest position, and a counter flange sealingly connecting the pump to the casing at the casing outlet opening;

a bushing extending into the casing and comprising a sealing connection ring having a lower cylindrical skirt portion and an upper band portion connected to the skirt portion;

said bushing also including a ferrule portion extending above the band portion and including an enlarged upper flange portion, said ferrule portion extending through said casing outlet and said flange portion arranged to support and center said bushing in said outlet;

a flexible bag for containing fluid-like substance within the casing and including an outlet sealingly attached to the skirt portion;

said pump tubular body including a substance flow conduit extending into said upper band portion through said ferrule portion and being sealingly connected to said band portion below said vent;

a lower intermediate space between said bag and interior of the casing, an upper intermediate space between the pump body and the ferrule, said upper intermediate space being in communication with said vent, and a passage providing communication between said lower intermediate space and said upper intermediate space.

2. A dispenser according to claim 1, wherein said band portion of said bushing has a smaller diameter than said pump tubular body sealingly connected thereto.

3. A dispenser according to claim 1, wherein the sealing connection between the pump tubular portion and said band comprises a friction fit between an outer surface of the tubular portion and an inside surface of the band.

4. A dispenser according to claim 1, wherein said pump includes a closing collar and said counterflange comprises an integral, single piece part of said collar.

5. A dispenser according to claim 1, wherein said ferrule portion adjacent the flange portion includes a cylindrical inner face having centering ribs thereon for engaging and centering the pump tubular body extending through the ferrule portion.

6. A dispenser according to claim 1, wherein said pump includes an intake area at the lower end of the tubular body and said bushing includes an inlet grid below said intake area, said inlet grid including a central orifice, a drain tube in communication with the central orifice, and laterally located intake orifices in communication with the intake area.

7. A dispenser according to claim 1, wherein the bushing seal connection ring includes a normally closed safety valve located beneath the pump tubular body when the body is assembled to the bushing, said safety valve comprising a pair of nested inner and outer valve elements configured to normally close the sealing connection ring against the flow of substance outwardly from the bag through the connection ring.

8. A dispenser according to claim 7, wherein said inner valve element includes a chamfered valve seat and the outer valve element comprises a movable valve member having a conical outer sealing surface for cooperating sealingly with the chamfered valve seat; said valve member connected to the connection ring by an elastically deformable perforated ring and having an axially extending finger extending into the connection ring for engagement and displacement by a pump tubular body inserted into the connection ring, said fingers providing a substance flow space between said valve and an inserted pump tubular body.

9. A dispenser according to claim 8, wherein said upper and lower intermediate spaces and the space surrounding a pump inserted into the sealing connection ring are filled with an inert gas.

* * * * *